US011371717B2

(12) United States Patent
Xu et al.

(10) Patent No.: US 11,371,717 B2
(45) Date of Patent: Jun. 28, 2022

(54) WIND OUTLET MECHANISM FOR RANGE HOOD

(71) Applicant: NINGBO FOTILE KITCHEN WARE CO., LTD., Zhejiang (CN)

(72) Inventors: Zhineng Xu, Zhejiang (CN); Anlin Chen, Zhejiang (CN); Fan Cai, Zhejiang (CN); Ting Yu, Zhejiang (CN)

(73) Assignee: NINGBO FOTILE KITCHEN WARE CO., LTD., Zhejiang (CN)

( * ) Notice: Subject to any disclaimer, the term of this patent is extended or adjusted under 35 U.S.C. 154(b) by 205 days.

(21) Appl. No.: 16/957,112

(22) PCT Filed: Jan. 28, 2019

(86) PCT No.: PCT/CN2019/073377

§ 371 (c)(1),
(2) Date: Jun. 23, 2020

(87) PCT Pub. No.: WO2019/149169

PCT Pub. Date: Aug. 8, 2019

(65) Prior Publication Data

US 2020/0393138 A1 Dec. 17, 2020

(30) Foreign Application Priority Data

Jan. 31, 2018 (CN) ..... 201820170365.2

(51) Int. Cl.
*F24C 15/20* (2006.01)
*F24F 13/20* (2006.01)

(52) U.S. Cl.
CPC ..... *F24C 15/2021* (2013.01); *F24C 15/2071* (2013.01); *F24C 15/2042* (2013.01); *F24F 13/20* (2013.01)

(58) Field of Classification Search
CPC .. F24C 15/20; F24C 15/2071; F24C 15/2021; B08B 15/002; B08B 15/02; B08B 15/023; B08B 2215/00

(Continued)

(56) References Cited

U.S. PATENT DOCUMENTS 3,401,624 A * 9/1968 Mohrman ..... F24F 7/025 454/344
4,996,910 A * 3/1991 Howorth ..... F24F 3/163 454/57

(Continued)

FOREIGN PATENT DOCUMENTS

CN 2687540 3/2005
CN 202577901 12/2012

(Continued)

OTHER PUBLICATIONS

"International Search Report (Form PCT/ISA/210) of PCT/CN2019/073377", dated Apr. 24, 2019, with English translation thereof, pp. 1-6.

*Primary Examiner* — Ko-Wei Lin
(74) *Attorney, Agent, or Firm* — JCIPRNET

(57) ABSTRACT

A wind outlet mechanism for a range hood comprises a wind outlet and a decorative cover. The decorative cover has a plurality of wind discharge holes, a flow guide member is disposed inside the decorative cover, and the flow guide member has a cambered flow guide surface opposite to and protruding toward the wind outlet. The flow guide surface can make the air flow discharged from the wind discharge holes on the decorative cover.

6 Claims, 4 Drawing Sheets

(58) Field of Classification Search
USPC ..... 454/56, 61–62, 67, 349–350, 354; 126/299 f
See application file for complete search history.

(56) References Cited

U.S. PATENT DOCUMENTS

| | | | | |
|---|---|---|---|---|
| 6,024,639 | A * | 2/2000 | Scherer | B64D 13/00 340/584 |
| 6,302,778 | B1 * | 10/2001 | Andrews | F24F 7/025 454/16 |
| 7,643,289 | B2 * | 1/2010 | Ye | G11B 33/142 361/695 |
| 8,273,162 | B2 * | 9/2012 | Pagano | B01D 53/0407 96/108 |
| 8,876,582 | B2 * | 11/2014 | Gao | F24F 7/007 454/341 |
| 2011/0083757 | A1 * | 4/2011 | Shore | F24F 13/20 361/679.01 |
| 2012/0132071 | A1 * | 5/2012 | Kusuura | B01D 49/006 95/92 |
| 2013/0319632 | A1 * | 12/2013 | Lee | F24F 12/006 165/59 |
| 2014/0165418 | A1 * | 6/2014 | Smith | F26B 21/004 34/227 |
| 2014/0170959 | A1 * | 6/2014 | Smith | A47K 10/48 454/305 |
| 2014/0231051 | A1 * | 8/2014 | Cho | F04D 29/281 165/121 |
| 2015/0096723 | A1 * | 4/2015 | Jeong | F25D 17/06 165/121 |
| 2015/0354874 | A1 * | 12/2015 | Cur | F24F 8/10 29/890.035 |
| 2016/0076789 | A1 * | 3/2016 | Kojima | F24F 1/0014 454/349 |
| 2016/0223211 | A1 * | 8/2016 | Xue | F24F 1/0047 |
| 2017/0115027 | A1 * | 4/2017 | Lee | F24F 1/0047 |
| 2017/0320005 | A1 * | 11/2017 | Vo | B01D 46/62 |
| 2018/0040493 | A1 * | 2/2018 | Kawai | B01D 53/04 |
| 2018/0306452 | A1 * | 10/2018 | Kim | F24F 13/20 |
| 2019/0186759 | A1 * | 6/2019 | Komatsu | F24F 1/06 |

FOREIGN PATENT DOCUMENTS

| | | |
|---|---|---|
| CN | 202835512 | 3/2013 |
| CN | 203024216 | 6/2013 |
| CN | 204114974 | 1/2015 |
| CN | 204254708 | 4/2015 |
| CN | 204806427 | 11/2015 |
| CN | 205402856 | 7/2016 |
| CN | 205669831 | 11/2016 |
| CN | 207907312 | 9/2018 |
| KR | 20170085631 | 7/2017 |
| SE | 8900016 | 7/1990 |

* cited by examiner

WIND OUTLET MECHANISM FOR RANGE HOOD

CROSS-REFERENCE TO RELATED APPLICATION

This application is a 371 of international application of PCT application serial no. PCT/CN2019/073377, filed on Jan. 28, 2019, which claims the priority benefit of China application no. 201820170365.2, filed on Jan. 31, 2018. The entirety of each of the above mentioned patent applications is hereby incorporated by reference herein and made a part of this specification.

BACKGROUND

Technical Field

The present invention relates to range hoods, and in particular to a wind outlet mechanism for a range hood.

Description of Related Art

Range hoods are classified into external-discharge range hoods and internal-circulation range hoods. For the internal-circulation range hoods, oil fume is purified by the range hoods and then discharged into the room, realizing the reuse of air. FIG. 1 shows an existing wind outlet mechanism for internal-circulation range hoods, wherein a wind guide box 5' is arranged at a wind outlet of the range hood; the bottom of the wind guide box 5' is open and connected to the wind outlet of the range hood via a connecting pipe 4'; wind outlet regions are provided at left and right ends of the wind guide box 5'; and the wind outlet regions are opposite to the wind discharge holes 20' on a decorative cover 2'. Air filtered by the internal-circulation range hood is blown out from a wind outlet hood, then divided into left and right air flows in the box after passing through the connecting pipe, and discharged from the wind discharge holes on the decorative hood.

The wind outlet mechanism is based on the right-angle tee mechanism. Wind from the wind outlet turns at a right angle when being blown upward to the wind guide box. Meanwhile, due to the limited spatial structure in the wind guide box, there is high wind discharge resistance in the connecting pipe, and the wind is directly blown onto the inner top surface of the air guide box to result in local noise. Although the existing wind guide box is designed to discharge wind from left and right sides, due to a high wind speed, the air flow is actually refracted on the inner top surface of the wind guide box, resulting in downward air flowing which affects the user's experience. Also, turbulent interference will occur in cookers with open flame.

SUMMARY

An object of the present invention is to provide a wind outlet mechanism for a range hood, with low noise.

For achieving the above object, the wind outlet mechanism for a range hood, comprises a wind outlet, a decorative cover having a plurality of wind discharge holes, surrounding the wind outlet, a flow guide member disposed inside the decorative cover. The flow guide member has a cambered flow guide surface opposite to and protruding toward the wind outlet.

Preferably, the flow guide surface is shaped as a circular arc, so that an air flow blown from the wind outlet from the bottom up can be guided to a horizontal direction by the flow guide member and then discharged from the wind discharge holes on the decorative cover, thereby reducing direct plane reflection.

Preferably, an adsorption medium layer for adsorbing fume is disposed on the flow guide surface. The adsorption medium layer can adsorb part of residual fume discharged from the wind outlet. Moreover, since there are many voids on the surface of the adsorption medium, the overall noise generated when discharging wind can be further reduced by decreasing the speed of air passing through the surface of the adsorption medium.

Preferably, the flow guide member is a circular plate, and the flow guide surface is formed at a bottom side of the flow guide member and protrudes downward.

To conveniently mount the flow guide member, preferably, a mounting bracket for the flow guide member be mounted above a side wall of the wind outlet is disposed between the wind outlet and the flow guide member inside the decorative cover.

The mounting bracket may be implemented specifically in various ways. Preferably, the mounting bracket comprises at least two connecting poles having two ends, one end of each connecting pole is fixedly connected with the flow guide member and the other end each connecting pole is fixedly connected with the end of the wind pipe.

To realize more stable connection between the flow guide member and the mounting bracket, preferably, the flow guide member has at least two mounting ears protruding from a circular edge of the flow guide member at intervals, and each mounting ear is connected with a corresponding connecting pole.

Preferably, the decorative cover has an upper portion, and the wind discharge holes are located at the upper portion of the decorative cover, and the flow guide member is located corresponding to a position of the wind discharge holes, therefore, it is convenient to discharge an air flow from the wind discharge holes.

Preferably, the decorative cover comprises a front side plate, a left side plate and a right side plate, each side plate has the wind discharge holes, and the wind discharge holes on each side plate are flush with each other.

Compared with the prior art, in the present invention, a flow guide member is arranged in the decorative cover, and the flow guide member has an arc-shaped flow guide surface opposite to the wind outlet. In this way, when an air flow is blown from the wind outlet to the flow guide surface from the bottom up, the flow guide surface can guide the air flow to another direction so that the air flow is discharged from the wind discharge holes on the decorative cover, thereby reducing direct plane reflection. Compared with the conventional wind outlet mechanisms, the wind outlet mechanism of the present invention is not obviously limited in space, and the internal space in the decorative cover can be fully utilized to provide a larger buffer region for discharging wind. Accordingly, the wind discharge resistance becomes low, the wind discharge rate at the wind discharge holes can be effectively reduced, and the noise is thus reduced.

DESCRIPTION OF THE EMBODIMENTS

To enable a further understanding of the present invention content of the invention herein, refer to the detailed description of the invention and the accompanying drawings below.

Embodiment 1

Figure 1:
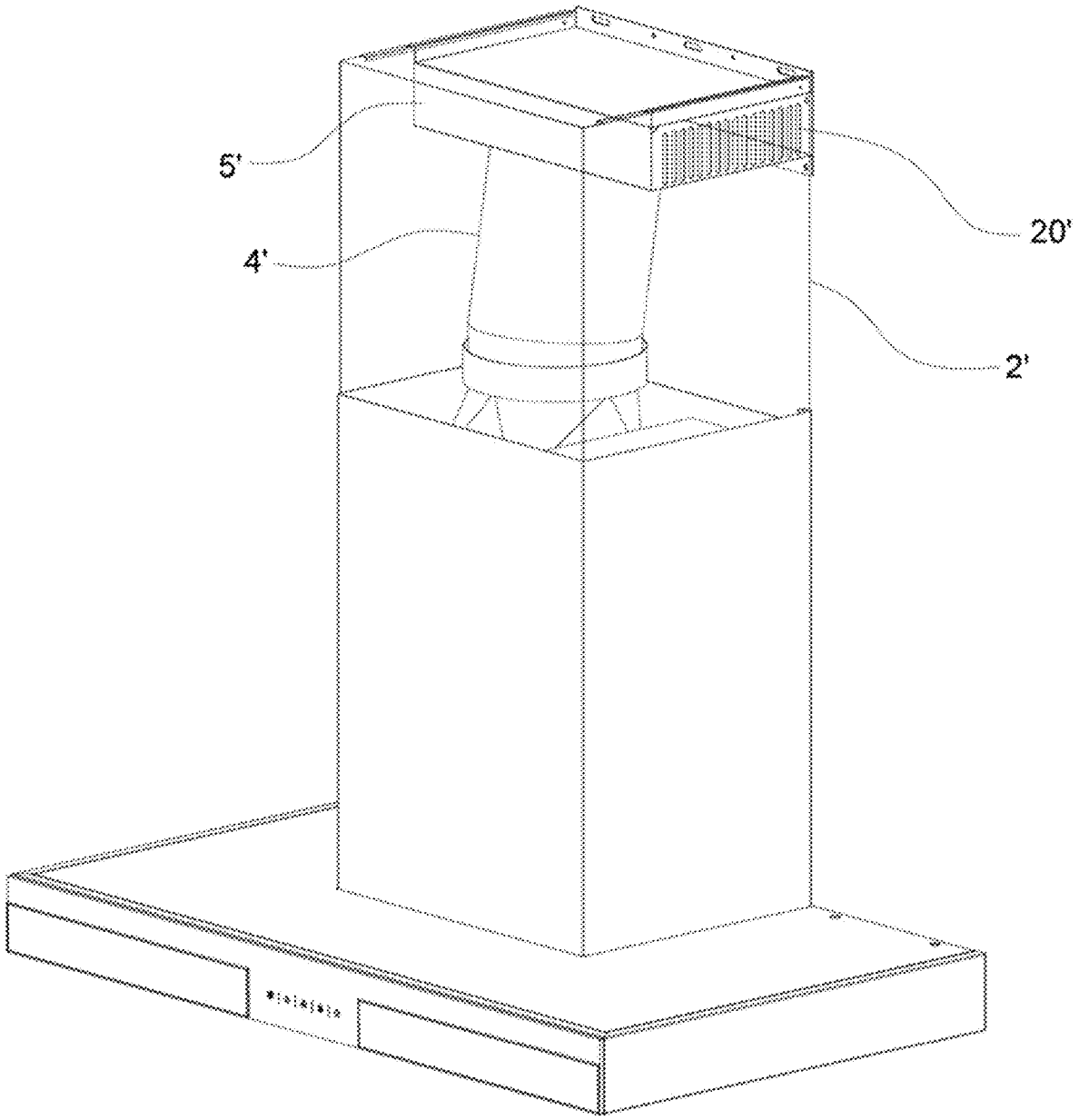
FIG. 1 is a perspective view of a wind outlet mechanism in the prior art.
Figure 2:
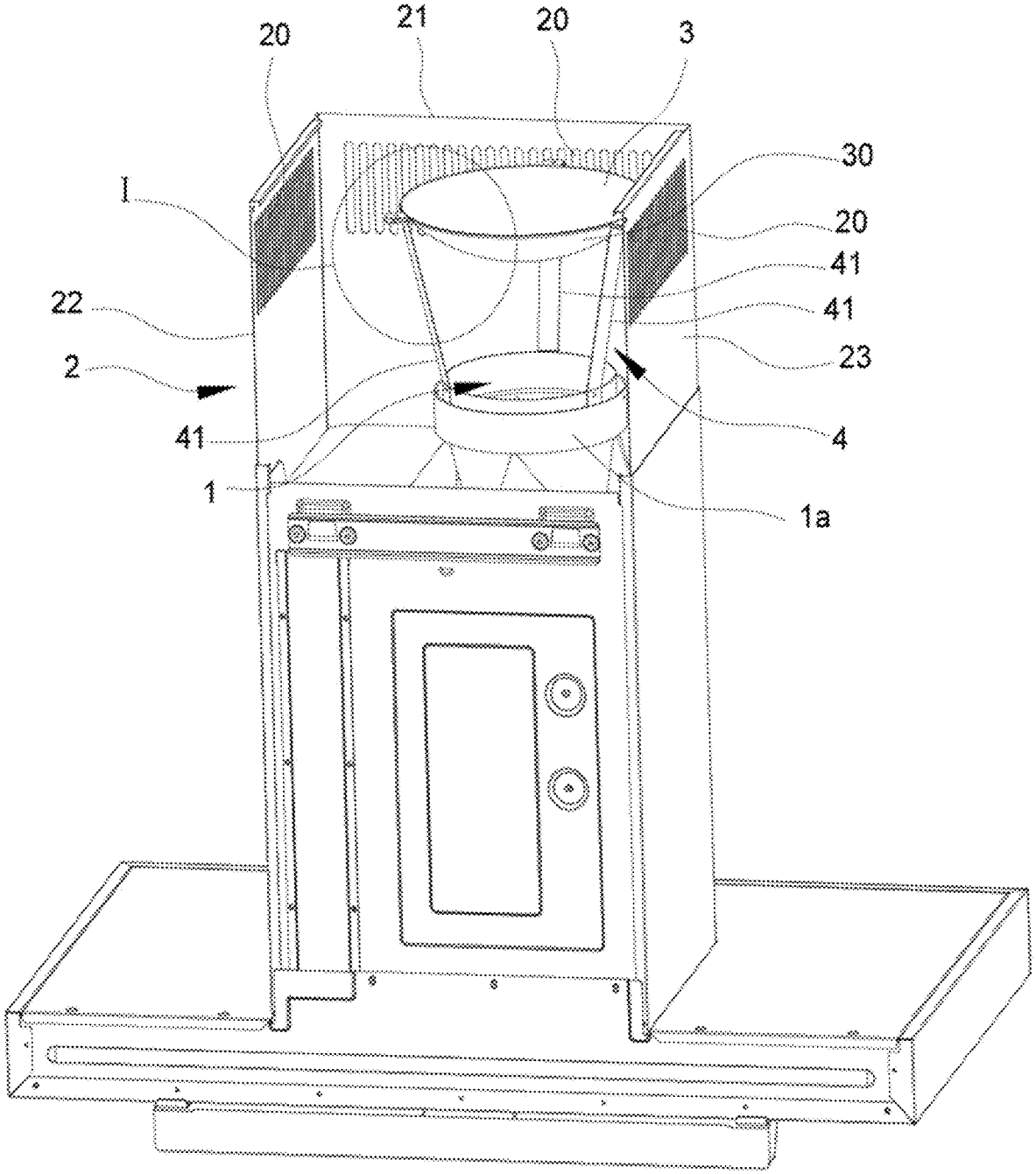
FIG. 2 is a perspective view of a wind outlet mechanism according to an Embodiment 1 of the present invention.
Figure 3:
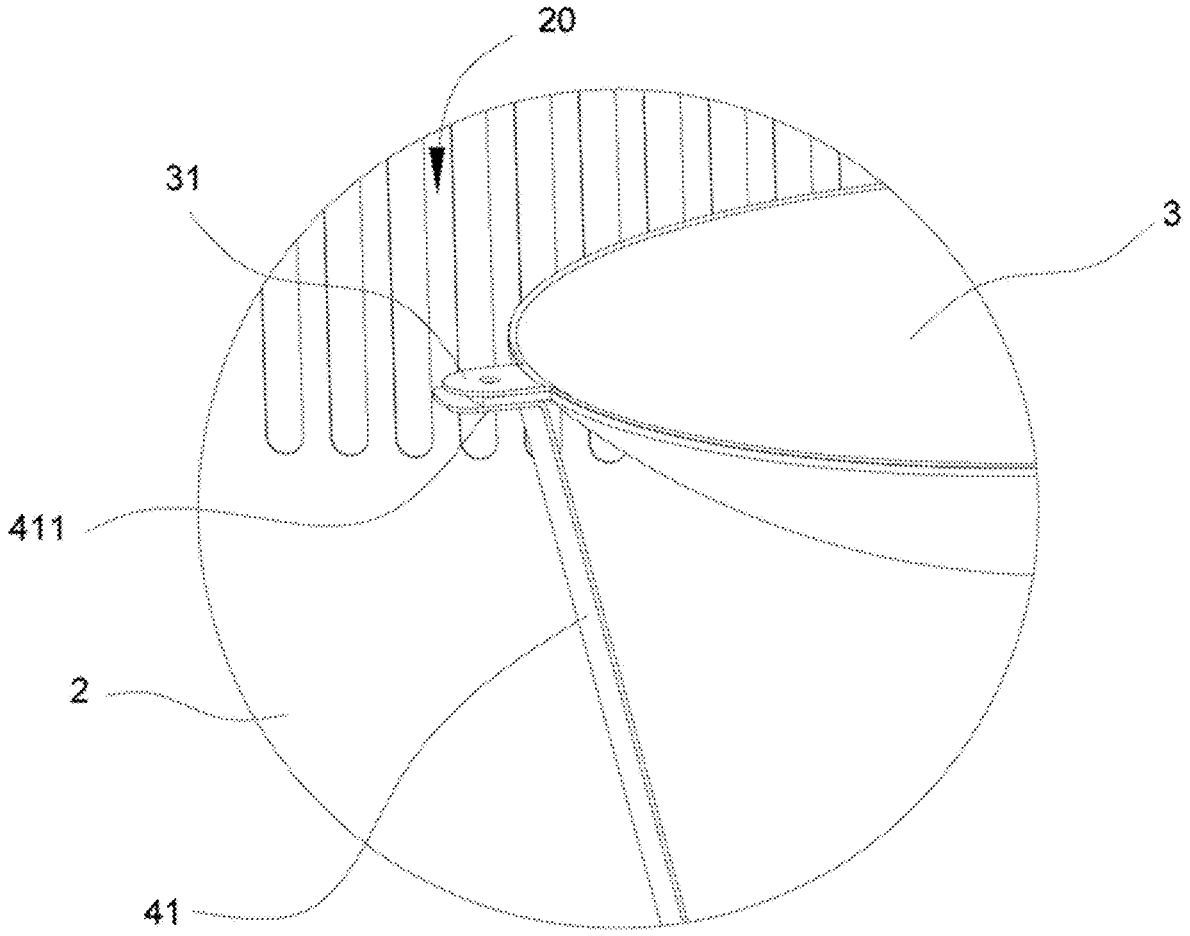
FIG. 3 is an enlarged view of Part-I in FIG. 2.

FIGS. 1-3 show a wind outlet mechanism for a range hood of an Embodiment 1 of the present invention. The wind outlet mechanism comprises a wind pipe 1*a* with a wind outlet 1, a decorative cover 2 and a flow guide member 3.

In this embodiment, the wind pipe 1*a* has a top end formed with an upward opening, and the wind outlet 1 is formed on the top end of the wind pipe 1*a*. Of course, the wind outlet 1 may also be formed by another portion of the wind pipe 1*a* or another component used for exporting an air flow from the range hood.

The decorative cover 2 is disposed around an outer periphery of the wind outlet 1 to shield the top end of the wind pipe 1*a*, and the decorative cover 2 has a plurality of wind discharge holes 20.

The flow guide member 3 is disposed inside the decorative cover 2, and the flow guide member 3 has a cambered flow guide surface 30 opposite to and protruding toward the wind outlet 1. In this embodiment, the flow guide surface 30 is shaped as a circular arc. In this way, when an air flow is directly blown from the wind outlet 1 to the flow guide surface 30 from bottom to up, the flow guide surface 30 can guide the air flow to a horizontal direction so that the air flow is discharged from the wind discharge holes 20 on the decorative cover 2, thereby reducing direct plane reflection. Moreover, the wind outlet mechanism in this embodiment is not obviously limited in space, and the internal space in the decorative cover 2 can be fully utilized to provide a larger buffer region for discharging wind. Accordingly, the wind discharge resistance becomes low, the wind discharge rate at the wind discharge holes 20 can be effectively reduced, and the noise is thus reduced.

In this embodiment, the flow guide member 3 is a circular plate, and the flow guide surface 30 is located at a bottom side of the flow guide member 3 and protrudes downward. To conveniently mount the flow guide member 3, a mounting bracket 4 for the flow guide member 3 be mounted above a side wall of the wind outlet 1 is disposed between the wind pipe 1*a* and the flow guide member 3 inside the decorative cover 2. The mounting bracket 4 may be implemented specifically in various ways. In this embodiment, the mounting bracket 4 comprises at least two connecting poles 41 having two ends, one end of each connecting pole 41 is connected with the flow guide member 3 and the other end each connecting pole 41 is connected with the end of the wind pipe 1*a*. Correspondingly, the flow guide member 3 has at least two mounting ears 31 protruding from the circular edge of the flow guide member 3 at intervals, and each mounting ear 31 is connected with a corresponding connecting pole 41. An upper end portion of each connecting pole 41 is bent to form a connecting portion 411 extending outward in a horizontal direction, and each connecting portions 411 is fixed with the mounting ears 31 by screws.

Further, in this embodiment, the decorative cover 2 comprises a front side plate 21, a left side plate 22 and a right side plate 23, each side plate has the wind discharge holes 20, and the wind discharge holes 20 on each side plate are flush with each other. The flow guide member 3 is located corresponding to the position of the wind discharge holes 20.

Embodiment 2

Figure 4:
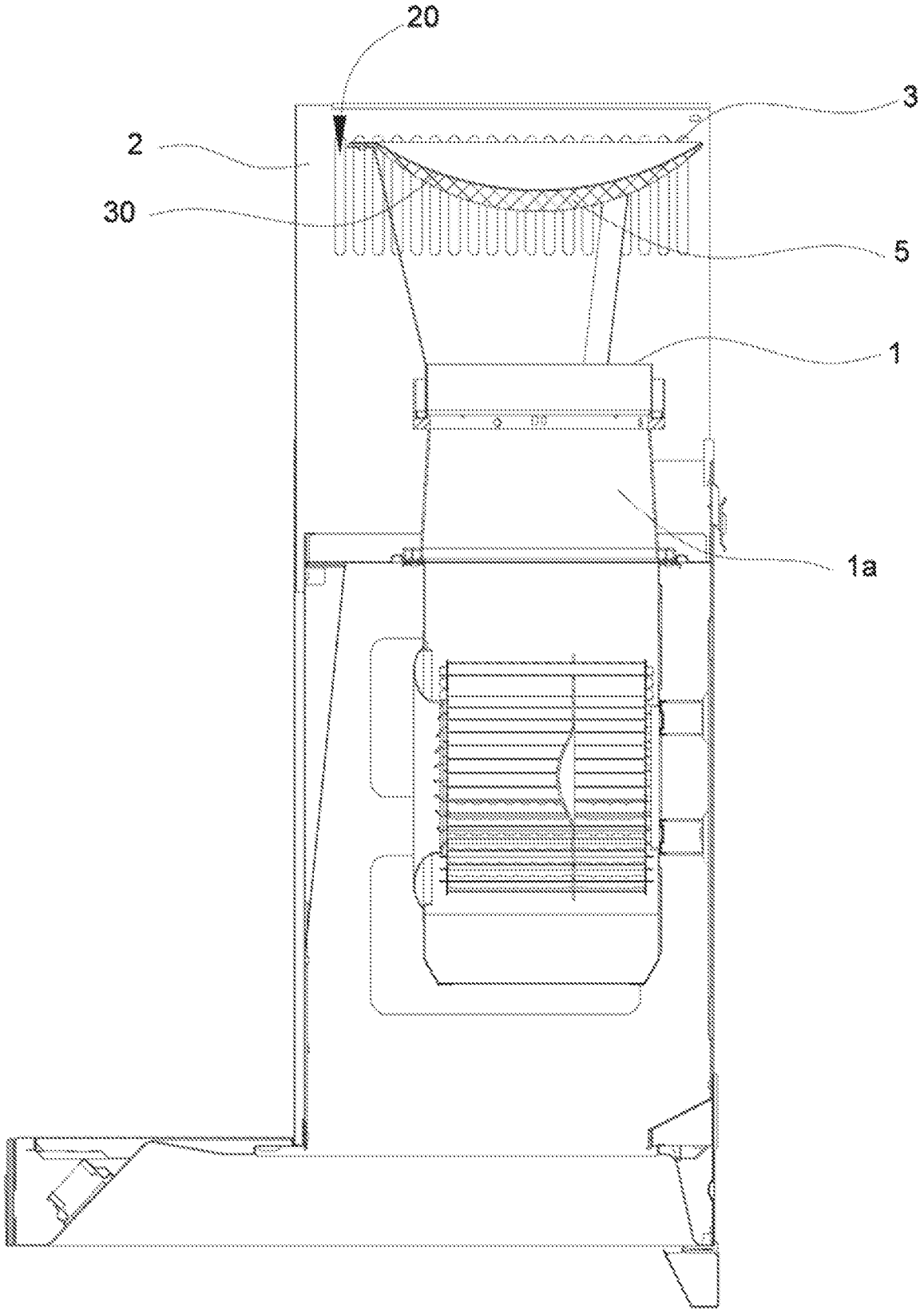
FIG. 4 is a sectional view of a wind outlet mechanism according to an Embodiment 2 of the present invention.

FIG. 4 shows Embodiment 2 of the present invention. This embodiment differs from the Embodiment 1 in that: in this embodiment, an adsorption medium layer 5 for adsorbing fume is arranged on a bottom surface of the flow guide surface 30. The adsorption medium layer 5 can adsorb part of residual fume discharged from the wind outlet 1. Moreover, since there are many voids on a surface of the adsorption medium, the overall noise generated when discharging wind can be further reduced by decreasing the speed of air passing through the surface of the adsorption medium.

What is claimed is:

1. A wind outlet mechanism for a range hood, comprising a wind outlet;

a decorative cover having a plurality of wind discharge holes and surrounding the wind outlet; and a flow guide member disposed inside the decorative cover;

wherein the flow guide member has a cambered flow guide surface opposite to and protruding toward the wind outlet, the flow guide member is a circular plate, the flow guide surface is formed at a bottom side of the flow guide member and protrudes downward, a mounting bracket for the flow guide member is mounted above a side wall of the wind outlet and is disposed between the wind outlet and the flow guide member inside the decorative cover, the wind outlet is formed on an end of a wind pipe, and the mounting bracket comprises at least two connecting poles having two ends, one end of each of the at least two connecting poles is fixedly connected with the flow guide member and the other end of the each of the at least two connecting poles is fixedly connected with the end of the wind pipe.

2. The wind outlet mechanism of claim 1, wherein the flow guide surface is shaped as a circular arc.

3. The wind outlet mechanism of claim 1, wherein an adsorption medium layer for adsorbing fume is disposed on the flow guide surface.

4. The wind outlet mechanism of claim 1, wherein the flow guide member has at least two mounting ears protruding from a circular edge of the flow guide member at intervals, and each of the at least two mounting ears is connected with a corresponding connecting pole.

5. The wind outlet mechanism of claim 1, wherein the decorative cover has an upper portion, and the plurality of wind discharge holes are located at the upper portion of the decorative cover, and the flow guide member is located corresponding to a position of the plurality of wind discharge holes.

6. The wind outlet mechanism of claim 5, wherein the decorative cover comprises a front side plate, a left side plate and a right side plate, each side plate has the plurality of wind discharge holes, and the plurality of wind discharge holes on each side plate are flush with each other.

* * * * *